US005270504A

United States Patent [19]

Grohs et al.

[11] Patent Number: 5,270,504

[45] Date of Patent: Dec. 14, 1993

[54] SLIDING CONTACT MEMBER FOR HIGH CURRRENT DENSITIES

[75] Inventors: Erhard Grohs, Oberursel; Lothar Biering, Frankfurt; Klaus Groht, Niddatal, all of Fed. Rep. of Germany; Conrad Reynvaan, Suresnes, France; Jürgen Spangenberg, Bad Vilbel; Arwed Uecker, Schwalbach, both of Fed. Rep. of Germany

[73] Assignee: Deutsche Carbone Aktiengesellschaft, Frankfurt, Fed. Rep. of Germany

[21] Appl. No.: 917,712

[22] Filed: Jul. 21, 1992

[30] Foreign Application Priority Data

Jul. 22, 1991 [EP] European Pat. Off. ..... 91 112 222.4

[51] Int. Cl.[5] ..... H01H 1/02

[52] U.S. Cl. ..... 200/265; 200/269

[58] Field of Search ..... 200/265, 268, 269

[56] References Cited

U.S. PATENT DOCUMENTS

| | | | |
|---|---|---|---|
| 2,234,834 | 3/1941 | Scott | 200/269 |
| 2,418,811 | 4/1947 | Adams et al. | 200/265 X |
| 4,332,988 | 6/1982 | Dungan et al. | 200/265 X |
| 4,443,726 | 4/1984 | Ikegami et al. | 310/248 |

FOREIGN PATENT DOCUMENTS

| | | |
|---|---|---|
| 154287 | 8/1902 | Fed. Rep. of Germany . |
| 289101 | 10/1912 | Fed. Rep. of Germany . |
| 3217217 | 9/1982 | Fed. Rep. of Germany . |
| 589917 | 7/1977 | Switzerland . |

*Primary Examiner*—Renee S. Luebke

*Attorney, Agent, or Firm*—Spencer, Frank & Schneider

[57] ABSTRACT

A sliding contact member substantially free of the toxic metals lead and antimony, includes copper, carbon, and at least one added material which is selected from the group consisting of a metal and a metal alloy having a melting temperature which is substantially below that of copper. The sliding contact member contains less than 10 percent by weight of the at least one added material. The sliding contact member is electrically conductive and capable of carrying high current densities, and the at least one added material provides a good cleaning effect, promotes cooling of the sliding contact member during operation, and provides good slidability against a mating contact member. This is achieved by keeping the at least one added material separate from the copper so that alloy formation is inhibited and, preferably, prevented.

15 Claims, 2 Drawing Sheets

SLIDING CONTACT MEMBER FOR HIGH CURRRENT DENSITIES

BACKGROUND OF THE INVENTION

1. Field of The Invention

The invention relates to a sliding contact member or article which is electrically conductive and capable of carrying high current densities, such as brushes for engine starters and slippers for pantographs of electrical trolleys or subway transport systems. More particularly, the sliding contact member according to the present invention is based on copper and carbon, and includes at least one added material which is a metal or a metal alloy having a melting temperature which lies significantly below the melting temperature of copper.

2. Background of The Art

Examples of sliding contact members include carbon brushes employed, for example, for engine starters, as well as slippers, for example, for pantographs of electrical trolleys or subway transport systems.

Conventional sliding contact members frequently include lead or antimony additives. The purpose of such additives is to provide a good cleaning effect, to promote cooling of the contact spots of the sliding contact member during operation, and to provide good slidability against a mating contact member. However, these known additives are toxic and damaging to the environment.

It is therefore an object of the present invention to provide a sliding contact member which does not contain any significant amounts of lead or antimony, but whose operating characteristics are not adversely affected.

SUMMARY OF THE INVENTION

The foregoing and other objects are accomplished by the present invention which provides a sliding contact member which is electrically conductive and capable of carrying high current densities comprising copper; carbon; and at least one added material which is selected from the group consisting of a metal and a metal alloy, which has a melting temperature which is substantially below that of copper, which is separate from the copper, and which is substantially free of lead and antimony. Thus, the present invention employs additives which are not environmentally objectionable and are preferably tin, zinc, and/or alloys of tin and zinc. However, these added materials cannot be simply mixed into the base components copper and carbon (graphite) because an alloy between the added materials and copper would result which would be much too hard for the desired purpose and which would not have a sufficiently low melting point. The present invention overcomes this difficulty by separating the added materials from the copper in such a way that the added materials are unable to form an alloy with copper. Thus, the added material as such is present in the sliding contact member and fulfills its purpose there without the sliding contact member containing any significant amount of lead or antimony.

The present invention additionally provides a starter comprising a stationary part; a moving part; and a plurality of carbon brushes which make sliding electrical contact between the stationary part and the moving part, which are electrically conductive and capable of carrying high current densities, and which are each configured as a sliding contact member as recited in the foregoing.

DESCRIPTION OF THE PREFERRED EMBODIMENTS

Figure 1:
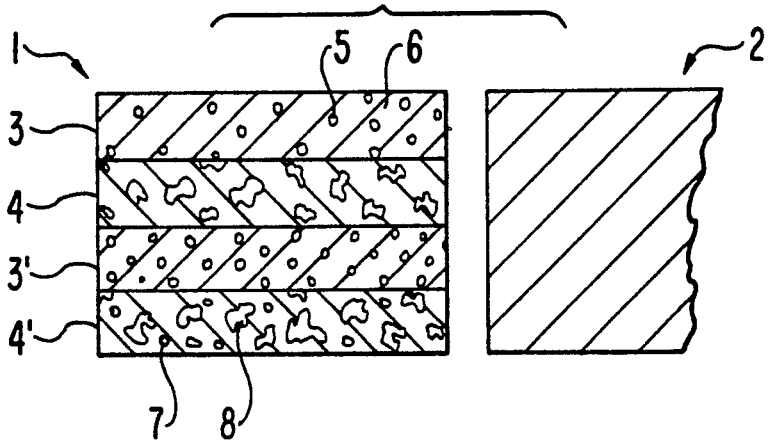
FIG. 1 is a schematic representation in cross-section of a sliding contact member according to the invention composed of a plurality of juxtaposed layers arranged so that they jointly contact a mating contact member.

The present invention provides the desired separation of the added material from the copper base component in one of three ways. In a first method, the at least one added material is in particulate form and is overcoated with a coating agent of a type and in an amount effective to inhibit formation of an alloy between the at least one added material and the copper. Coating of the added material is performed before it is mixed in with the base copper and carbon components prior to introduction of the mixture into a press mold in which the sliding contact member is produced.

In a second method, the at least one added material is in particulate form and the sliding contact member further comprises a binder into which the at least one added material is incorporated. The binder is of a type and present in an amount effective to inhibit formation of an alloy between the at least one added material and the copper. Separation of the added material from copper is affected during manufacture of the sliding contact member in which the at least one added material is, in essence, coated by the binder. The binder in this method for achieving separation may be the base carbon component itself (graphite), optionally together with other binder additives known in the art.

In a third method, the sliding contact member is composed of a plurality of juxtaposed layers including at least one copper-containing layer and at least one added material-containing layer arranged next to one another in such a way that they jointly contact a mating contact member, such as a current tap or collector. The at least one copper-containing layer comprises copper and carbon but does not contain the at least one added material, and the at least one added material-containing layer comprises at least one added material, but does not contain copper. Thus, the copper and the at least one added material ar separated from one another as being included in separate layers. The individual layers are pressed or glued together in any suitable order and by any suitable lamination technique known in the art, and thus form the sliding contact member.

As used herein, therefore, the term "sliding contact member" is intended to include a sliding contact member which is comprised of a homogeneous blend of copper, carbon and at least one added material, as well as a sliding contact member which is comprised of a plurality of juxtaposed layers in which the carbon and the at least one added material are present in separate layers.

The sliding contact member according to the present invention preferably contains less than ten percent by weight of the at least one added material. Such additive weight percentages are conventional for sliding contact members based on copper and carbon. Preferably the at least one added material consists essentially of tin, zinc, or alloys of tin and zinc which are non-toxic. The metals or alloys of the at least one added material are substantially free of lead and antimony, which are known to be toxic and damaging to the environment, and preferably contain at most only impurity amounts of these toxic metals.

The coating agents and binders according to the present invention may be the same materials and are preferably selected from the group consisting of a thermosetting resin (a duroplast), a thermoplastic polymer (a thermoplast), tar, pitch, water glass, a metal, an alloy, graphite, and mixtures thereof. Preferably, the overcoatings and binders are electrically conductive either inherently in the case of, for example, metals and alloys, or due to coking of, for example, the resins and polymers during the manufacturing process for the sliding contact member. Most preferably, the coating agent and binder are selected from the group consisting of a synthetic thermosetting resin, a metal which is one of chromium and nickel, and an alloy of chromium and nickel.

Preferably the melting temperature of the metal constituent(s) of the at least one added material lies substantially below that of copper (about 1083° C.). For example, the melting point of tin is about 232° C. and the melting point of zinc is about 419° C. Preferably the oxide of the added materials is no harder than about seven measured according to the Mohs scale of hardness of minerals.

A preferred method of manufacturing the inventive sliding contact members includes mixing ingredients in particulate form to obtain a uniform mixture, filling the uniform mixture into a mold, and press molding under suitable conditions of temperature and pressure to obtain a sliding contact member of the desired shape. Other methods are useful, however, such as extrusion or coextrusion. In the multilayered embodiment, for example, layers may be press molded or extruded and laminated together with heat and pressure or with an adhesive and pressure as is known in the art.

The carbon employed in the sliding contact member is artificial or natural graphite with an addition of cokified binder material. In sliding contacts for slippers for pantographs, the carbon is substantially coke.

Said carbon is mixed with copper powder, the proportions in the mixture depending upon the intended use of the contact member. Considering only the relationship between the copper and carbon, for commutator brushes one employs about 20–70 weight % copper and the rest carbon. For slippers for pantographs, one employs about 10–30 weight % copper and the rest carbon.

The copper powder usually is in dendritic form, in flake form or in atomized form. Carbon usually is taken as flakes. The added material usually is in powdered form.

The particle size of carbon is larger than 15 μm and ranges up to about 500 μm in sliding contact members for starter brushes. For sliding contact members for slippers for pantographs, the particle size of the carbon usually is larger than 10 μm and its upper limit is about 500 μm.

It has been stated that no significant amounts of lead or antimony are present in the sliding contact member. This means that these elements can be present only as impurities. These elements are not added voluntarily when preparing the sliding contact members.

The following is an example of the manufacture of a sliding contact member useful as a starter brush.

A pre-mixture is made containing 3–15 weight % tin or zinc powder which is mixed with graphite flakes and a thermosetting resin, for example, NOVOLACK. This pre-mixture contains 4–20 weight % thermosetting resin and the rest is graphite.

The zinc or tin powder is encapsulated by the graphite flakes which are glued together with the binder NOVOLACK. In this respect, please also see the representation of a magnified view shown in FIG. 3 and its description.

After intensive mixing, grinding and sieving, the premixture is used for the final blend with copper and $MoS_2$.

The final blend contains 60–70 weight % copper powder, 2–5 weight % $MoS_2$ which serves as a high-temperature lubricant, and the rest is the pre-mixture.

The final blend is cold molded with a pressure of 1–6 tons per $cm^2$ and baked, in a batch or continuous process, in a reducing atmosphere at about 450° C.

Useful duroplasts for the sliding contact member include all duroplasts which are based upon phenolic, for instance, NOVOLACK, CRESOL or RESOL. Useful thermoplasts are high-temperature resistant thermoplasts, including, for example, PPS (polypheylene-sulphide), for instance RAYTON (made by DuPont).

Figure 2:
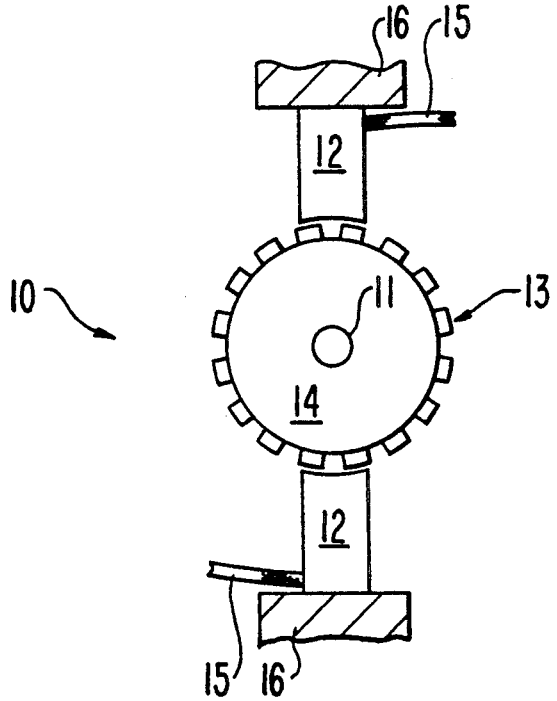
FIG. 2 is a schematic representation of a starter including a plurality of carbon brushes which are each configured as a sliding contact member according to the present invention.
Figure 3:
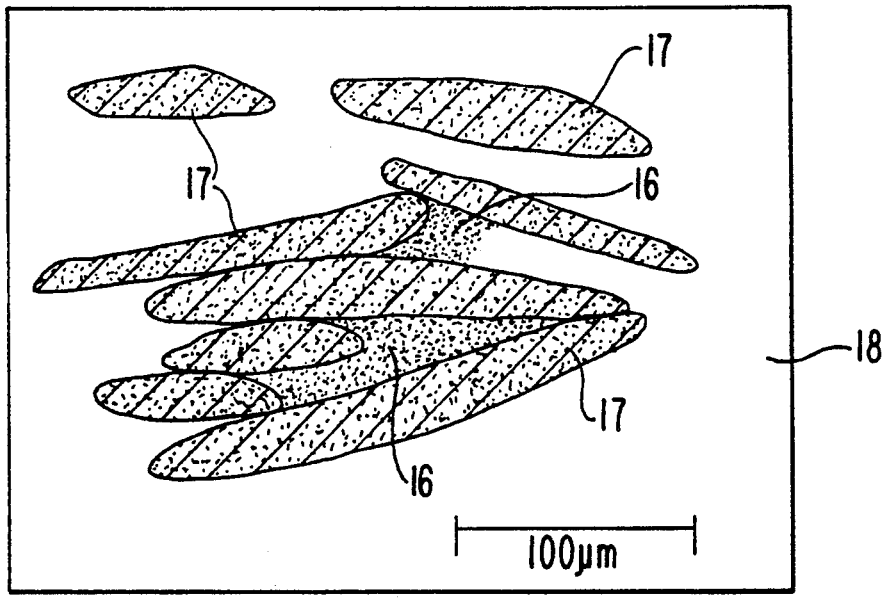
FIG. 3 is a representation of a magnified view of a cross-section of a sliding contact member according to the invention.

Turning to FIGS. 1, 2 and 3, offered by way of explanation but not limitation, FIG. 1 is a schematic representation in cross-section of a sliding contact member according to the invention shown generally at 1 composed of a plurality of juxtaposed layers 3,4,3',4' arranged so that they jointly contact a mating contact member shown generally at 2 in use. Layers 3,3' are added material-containing layers comprising particles of at least one added material 5 dispersed in a binder 6, such as graphite or a synthetic thermosetting resin after coking. Layers 3,3' contain no copper. Layers 4,4' are copper-containing layers comprising particles of copper 7 and particles of carbon 8. Layers 4,4' contain no added material. Layers 3,3',4,4' are laminated together and jointly contact mating contact member 2 in use FIG. 2 is a schematic representation of a portion of a starter shown generally at 10 including a moving part shown as a cylindrical commutator 14 which turns around its axis 11 and has commutator bars 13 made of copper provided at its surface. Opposite commutator bars 13, carbon brushes 12 made according to the present invention, are provided and mounted in a stationary part shown schematically at 16. Flexible electrical connection wires 15 are connected to the carbon brushes 12. The carbon brushes 12 make sliding electrical contact with the commutator bars 13.

FIG. 3 is a representation of a magnified view of a cross-section of a sliding contact member according to the invention. FIG. 3 shows areas 16 containing tin or zinc and other areas 17 containing graphite flakes 17. The remaining areas 18 contain copper and $MoS_2$. A 100 μm scale is indicated in FIG. 3.

It is understood that various other modifications will be apparent to and can be readily made by those skilled in the art without departing from the scope and spirit of the present invention. Accordingly, it is not intended that the scope of the claims appended hereto be limited to the description set forth above but rather that the claims be construed as encompassing all of the features of patentable novelty which reside in the present invention, including all features which would be treated as equivalents thereof by those skilled in the art to which the invention pertains.

What is claimed is:

1. A sliding contact member which is electrically conductive and capable of carrying high current densities, comprising:

copper;

carbon; and at least one added material which is selected from the group consisting of a metal and a metal alloy, which has a melting temperature which is substantially below that of copper, which is separate from the copper, and which is substantially free of lead and antimony, wherein the sliding contact member contains less than 10 percent by weight of the at least one added material.

2. The sliding contact member according to claim 1, wherein the at least one added material is in particulate form, and wherein the particles of the at least one added material are overcoated with a coating agent of a type and in an amount effective to inhibit formation of an alloy between the at least one added material and the copper.

3. The sliding contact member according to claim 2, wherein the at least one added material is selected from the group consisting of tin, zinc, and an added alloy of tin and zinc.

4. The sliding contact member according to claim 2, wherein the coating agent is selected from the group consisting of a thermosetting resin, a thermoplastic polymer, tar, pitch, water glass, a metal, an alloy, graphite, and a mixture of at least two of the foregoing.

5. The sliding contact member according to claim 4, wherein the coating agent is selected from the group consisting of a synthetic thermosetting resin, a metal which is one of chromium and nickel, and an alloy of chromium and nickel.

6. The sliding contact member according to claim 1, wherein the at least one added material is in particulate form, wherein the sliding contact member further comprises a binder into which the at least one added material is incorporated, and wherein the binder is of a type and present in an amount effective to inhibit formation of an alloy between the at least one added material and the copper.

7. The sliding contact member according to claim 6, wherein the at least one added material is selected from the group consisting of tin, zinc, and an alloy of tin and zinc.

8. The sliding contact member according to claim 6, wherein the binder is selected from the group consisting of a thermosetting resin, a thermoplastic polymer, tar, pitch, water glass, a metal, an alloy and graphite.

9. The sliding contact member according to claim 8, wherein the binder is selected from the group consisting of a synthetic thermosetting resin, a metal which is one of chromium and nickel, and an alloy of chromium and nickel.

10. The sliding contact member according to claim 1, wherein the sliding contact member is composed of a plurality of juxtaposed layers including at least one copper-containing layer and at least one added material-containing layer arranged so that they jointly contact a mating contact member in use, and wherein the at least one copper-containing layer comprises copper and carbon but does not contain the at least one added material, and the at least one added material-containing layer comprises at least one added material but does not contain copper.

11. The sliding contact member according to claim 10, wherein the at least one added material is selected from the group consisting of tin, zinc, and an alloy of tin and zinc.

12. The sliding contact member according to claim 10, wherein the at least one added material is in particulate form and is incorporated into one of the carbon and a binder.

13. The sliding contact member according to claim 12, wherein the binder is selected from the group consisting of a thermosetting resin, a thermoplastic polymer, tar, pitch, water glass, a metal, an alloy and graphite.

14. The sliding contact member according to claim 13, wherein the binder is selected from the group consisting of a synthetic thermosetting resin, a metal which is one of chromium and nickel, and an alloy of chromium and nickel.

15. A starter, comprising:

a stationary part;

a moving part; and a plurality of carbon brushes which make sliding electrical contact between the stationary part and the moving part, which are electrically conductive and capable of carrying high current densities, and which are each configured as a sliding contact member according to claim 1.

* * * * *